United States Patent [19]

Forester

[11] Patent Number: 4,578,178

[45] Date of Patent: Mar. 25, 1986

[54] METHOD FOR CONTROLLING FOULING DEPOSIT FORMATION IN A PETROLEUM HYDROCARBON OR PETROCHEMICAL

[75] Inventor: David R. Forester, The Woodlands, Tex.

[73] Assignee: Betz Laboratories, Inc., Trevose, Pa.

[21] Appl. No.: 607,084

[22] Filed: May 4, 1984

Related U.S. Application Data

[63] Continuation-in-part of Ser. No. 543,576, Oct. 19, 1983, abandoned.

[51] Int. Cl.[4] ..... C10G 9/12; C10G 9/16

[52] U.S. Cl. ..... 208/48 AA; 585/950; 208/106

[58] Field of Search ..... 208/48 AA; 252/46.6; 585/950

[56] References Cited

U.S. PATENT DOCUMENTS

| | | |
|---|---|---|
| 2,785,128 | 3/1957 | Popkin . |
| 3,105,810 | 10/1963 | Miller et al. . |
| 3,123,630 | 3/1964 | Oberender et al. . |
| 3,135,729 | 6/1964 | Kluge et al. . |
| 3,162,671 | 12/1964 | Petersen et al. . |
| 3,201,438 | 8/1965 | Reed . |
| 3,271,295 | 9/1966 | Gonzalez . |
| 3,271,296 | 9/1966 | Gonzalez . |
| 3,281,359 | 10/1966 | Oberender et al. . |
| 3,301,923 | 1/1967 | Skovronek et al. . |
| 3,437,583 | 4/1969 | Gonzalez . |
| 3,442,791 | 5/1969 | Gonzalez . |
| 3,489,682 | 1/1970 | Lesuer . |
| 3,516,922 | 6/1970 | Anzilotti . |
| 3,567,623 | 3/1971 | Hagney . |
| 3,966,622 | 6/1976 | Hellmuth et al. . |
| 4,024,048 | 5/1977 | Shell et al. ..... 208/48 AA |
| 4,024,050 | 5/1977 | Shell et al. . |
| 4,024,051 | 5/1977 | Shell et al. ..... 208/48 AA |
| 4,025,458 | 5/1977 | McKay . |
| 4,107,030 | 8/1978 | Slovinsky et al. . |
| 4,188,298 | 2/1980 | Reinhard et al. . |
| 4,400,283 | 8/1983 | Horodysky et al. . |

*Primary Examiner*—John Doll
*Assistant Examiner*—Chung K. Pak
*Attorney, Agent, or Firm*—Alexander D. Ricci; Bruce E. Peacock

[57] ABSTRACT

A method for controlling the formation of fouling deposits in a petroleum hydrocarbon or a petrochemical during processing at elevated temperatures, comprising dispersing within said petroleum hydrocarbon or petrochemical an antifouling amount of a polyalkenylthiophosphonic acid or ester thereof.

8 Claims, No Drawings

METHOD FOR CONTROLLING FOULING DEPOSIT FORMATION IN A PETROLEUM HYDROCARBON OR PETROCHEMICAL

CROSS REFERENCE TO RELATED APPLICATION

The present application is a continuation-in-part of application Ser. No. 543,576 filed Oct. 19, 1983, now abandoned.

FIELD OF THE INVENTION

The present invention pertains to a method for providing antifouling protection for petroleum hydrocarbons or petrochemicals during processing thereof at elevated temperatures.

BACKGROUND

In the processing of petroleum hydrocarbons and feedstocks such as petroleum processing intermediates, and petrochemicals and petrochemical intermediates, e.g., gas, oils and reformer stocks, chlorinated hydrocarbons and olefin plant fluids such as deethanizer bottoms the hydrocarbons are commonly heated to temperatures of 100° to 1000° F. Similarly, such petroleum hydrocarbons are frequently employed as heating mediums on the "hot side" of heating and heat exchange systems. In both instances, the petroleum hydrocarbon liquids are subjected to elevated temperatures which produce a separate phase known as fouling deposits, within the petroleum hydrocarbon. In all cases, these deposits are undesirable by-products. In many processes, the deposits reduce the bore of conduits and vessels to impede process throughput, impair thermal transfer, and clog filter screens, valves and traps. In the case of heat exchange systems, the deposits form an insulating layer upon the available surfaces to restrict heat transfer and necessitate frequent shut-downs for cleaning. Moreover these deposits reduce throughput, which of course, results in a loss of capacity with a drastic effect in the yield of finish product. Accordingly, these deposits have caused considerable concern to the industry.

While the nature of the foregoing deposits defies precise analysis, they appear to contain either or a combination of carbonaceous phases which are coke-like in nature, polymers or condensates formed from the petroleum hydrocarbons or impurities present therein and salt formations which are primarily composed of magnesium, calcium and sodium chloride salts. The catalysis of such condensates has been attributed to metal compounds such as copper or iron which are present as impurities. For example, such metals may accelerate the hydrocarbon oxidation rate by promoting degenerative chain branching, and the resultant free radicals may initiate oxidation and polymerization reactions which form gums and sediments. It further appears that the relatively inert carbonaceous deposits are entrained by the more adherent condensates or polymers to thereby contribute to the insulating or thermal opacifying effect.

Fouling deposits are equally encountered in the petrochemical field wherein the petrochemical is either being produced or purified. The deposits in this environment are primarily polymeric in nature and do drastically affect the economies of the petrochemical process. The petrochemical processes include processes ranging from those where ethylene or propylene, for example, are obtained to those wherein chlorinated hydrocarbons are purified.

SUMMARY OF THE INVENTION

In accordance with the invention, I have surprisingly found that addition of a polyalkenylthiophosphonic acid or alcohol/polyglycol ester of such polyalkenylthiophosphonic acid to the desired petroleum hydrocarbon or petrochemical, significantly reduces the fouling tendencies of the petroleum hydrocarbon or petrochemical during high temperature processing thereof.

PRIOR ART

As to the polyalkenylthiophosphonic acid compounds or alcohol/polyglycol esters thereof which are to be used in the present invention, these are disclosed in U.S. Pat. No. 3,281,359 (Oberender et al). In Oberender et al, these compounds are disclosed as being useful "detergent-dispersant additives in lubricating oil, particularly petroleum lubricating oil" see column 1 lines 20–21. In contrast, the method of the present invention utilizes these compounds to inhibit fouling in petroleum hydrocarbons or petrochemicals and studies have shown that many compounds known to be useful as lubricating oil detergent-dispersants do not adequately function as process antifoulants.

Of somewhat lesser interest is thought to be U.S. Pat. No. 3,123,160 (Oberender et al) which relates to a process for preparing monohydroxyalkyl hydrocarbyl thiophosphonates by reacting hydrocarbyl thiophosphoric acids with alkylene oxides in the absence of a catalyst.

Other patents which may be of interest to the present invention include: U.S. Pat. No. 4,024,051 (Shell) disclosing the use of inorganic phosphorus containing acid compounds and/or salts thereof as antifoulants; U.S. Pat. No. 3,105,810 (Miller) disclosing oil soluble alkaryl sulfur containing compounds as antifoulants; U.S. Pat. No. 4,107,030 (Slovinsky et al) disclosing sulfanilic acid amine salt compounds as antifoulants; U.S. Pat. No. 3,489,682 (Lesuer) disclosing methods for preparing metal salts of organic phosphorus acids and hydrocarbon substituted succinic acids; and U.S. Pat. No. 2,785,128 (Popkin) disclosing methods for preparing metal salts of acidic-phosphorus-containing organic compounds.

U.S. Pat. Nos. 3,437,583 (Gonzalez); 3,567,623 (Hagney); 3,217,296 (Gonzalez); 3,442,791 (Gonzalez) and 3,271,295 (Gonzalez); 3,135,729 (Kluge and LaCoste); 3,201,438 (Reed) and 3,301,923 (Skovronek) may also be mentioned as being of possible interest.

DETAILED DESCRIPTION OF THE PRESENT INVENTION

Preparative routes for synthesizing the polyakenylthiophosphonates and the alcohol/polyglycol esters thereof are disclosed in the aforementioned U.S. Pat. No. 3,281,359. Accordingly, the entire disclosure of this patent is incorporated herein by reference. As is expressed therein, the polyalkenyl-$P_2S_5$ reaction products may be prepared by reacting alkenyl polymers such as polyethylene, polypropylene, polyisopropylene, polyisobutylene, polybutene or copolymers comprising such alkenyl repeat unit moieties with $P_2S_5$ (at about 5–40 wt. percent of the reaction mass) at a temperature of from about 100° to about 320° C. in the presence of between about 0.1–5.0 wt. percent sulfur.

The resulting reaction mixture is then diluted with mineral oil and is then steam hydrolyzed. If desired, the hydrolyzed polyalkenyl-$P_2S_5$ reaction product may then be esterified, by further reaction with lower alkyl ($C_1$–$C_5$) alcohols such as methanol, ethanol, propanol, butanol etc. or with a polygylcol such as hexylene glycol or pentaerythritol.

As the —359 patent states, it is highly desirable to employ, as a precursor material, an alkenyl polymer having an average molecular weight of between about 600 and 5,000.

At present, the reaction product preferred for use is the pentaerythritol ester of polyisobutenylthiophosphonic acid. This particular ester is commercially available and is hereinafter referred to as PETPA. The polyisobutenyl moiety of PETPA has been reported as having an average molecular weight of about 1300. The product is sold as a 40 vol % solution in mineral oil. It has a specific gravity of 0.92 at 60° F. and a viscosity of 63.9 CST at 210° F.

PETPA is prepared by mixing polyisobutene (average molecular weight of 750–2000) with $P_2S_5$ (polybutene-$P_2S_5$ molar ratio of 0.9–1.25) in the presence of sulfur at 300°–600° F. until the reaction product is soluble in n-pentane. The product is diluted with paraffin base distillate, steamed for 4–10 hours at 350°–375° F., then dried with $N_2$ at 350°–375° F. The product is extracted with 50–100% by volume of methanol at 75°–150° F. to leave a lubricating oil raffinate containing a polyisobutenethiophosphonic acid. This material is reacted with pentaerythritol to yield PETPA.

The antifoulants of the invention may be dispersed within the petroleum hydrocarbon or petrochemical within the range of about 0.5–10,000 ppm based upon one million parts petroleum hydrocarbon or petrochemical. Preferably, the antifoulant is added in an amount of from about 1 to 500 ppm.

EXAMPLES

The invention will now be further described with reference to a number of specific examples which are to be regarded solely as illustrative and not as restricting the scope of the invention.

EAMPLE ONE

Preparation of hexylene glycol ester of polyisobutenylthiophosphonic acid 330 g. of polyisobutenylthiophosphonic acid (0.1 mole), (MW of isobutenyl moiety≈1300) 11.8 g. of hexylene glycol (0.1 mole) and 100 g. of xylene were added to a 500 mL reaction kettle equipped with thermometer, traps, condenser and drying tube. The mixture was slowly heated to reflux (≈150° C.) and maintained for about two hours. After this, the temperature was slowly increased. Between about 138°–176° C., liquids starting to condense in the traps leaving hexylene glycol ester of polyisobutenyl thiophosphonic acid (HGETPA) in the flask. This product was analyzed for residual alcohol and none was deleted.

EXAMPLE TWO

Preparation of n-butanol ester of polyisobutenthiophosphonic acid 330 g. of polyisobutenylthiophosphonic acid (0.1 mole), (MW of isobutenyl moiety≈1300) 7.4 g. n-butanol (0.1 mole) and 100 g. xylene were added to a 500 mL reaction kettle equipped with thermometer, traps, ice condenser, and drying tube.

The mixture was heated to reflux slowly over about a two hour period. Condensates were caught in the trap, with the resulting n-butanol ester of polyisobutenylthiophosphonic acid (BETPA) remaining in the reaction kettle. This product was analyzed for residual alcohol and none was detected.

FOULING APPARATUS TESTS

In order to ascertain the antifoulant efficacy of the antifoulant treatment in accordance with the invention, process fluid is pumped from a Parr bomb through a heat exchanger containing an electrically heated rod. Then, the process fluid is chilled back to room temperature in a water cooled condenser before being remixed with the fluid in the bomb. The system is pressurized by nitrogen to minimize vaporization of the process fluid.

In this particular set of examples, the rod temperature is controlled at a desired temperature. As fouling occurs, less heat is transferred to the fluid so that the process fluid outlet temperature decreases. Accordingly, antifoulants are said to provide antifouling protection based on the percent reduction in the oil outlet ΔT when compared to a control sample (no antifoulant present) in accordance with the equation:

$$\frac{\Delta T \text{ proc.fl. (cntl.)} - \Delta T \text{ proc.fl. (antifoulant spl.)}}{\Delta T \text{ process fluid (control)}} \times 100 = \% \text{ Protection}$$

Results are reported in Table I

TABLE I

| Additive, | Dose (ppm) | Rod Temp | −ΔT | % Protection |
|---|---|---|---|---|
| PROCESS FLUID - CRUDE OIL - MIDWEST REFINERY | | | | |
| Blank (Control) | | 920° F. | 93,91 | — |
| 40% ZZ | 1,000 | 920° F. | 64 | 30 |
| 40% PETPA | 1,000 | 920° F. | 21 | 77 |
| PROCESS FLUID - CRUDE OIL - EAST COAST REFINERY | | | | |
| Blank (Control) | | 930° F. | 74,67,68 | — |
| 40% ZZ | 1,000 | 930° F. | 89 | −27 |
| 40% PETPA | 1,000 | 930° F. | 16 | 77 |
| PROCESS FLUID - CRUDE OIL - MIDWEST REFINERY | | | | |
| Blank (Control) | | 880° F. | 44,45,28 | — |
| 40% PETPA | 500 | 880° F. | 8,14 | 79,64 |
| 40% ZZ | 500 | 880° F. | 16 | 59 |
| Blank (Control) | | 880° F. | 40,28 | — |
| 40% PETPA | 500 | 880° F. | 0 | 100 |
| 40% ZZ | 500 | 880° F. | 19 | 44 |
| Blank (Control) | 880° F. | 43,33 | — | |
| 40% ZZ | 500 | 880° F. | 24 | 44 |
| 40% PETPA | 500 | 880° F. | 7 | 84 |
| PROCESS FLUID - CRUDE OIL - EAST COAST REFINERY | | | | |
| Blank (Control) | | 750° F. | 43,34,38 | — |
| 40% ZZ | 500 | 750° F. | 22,10 | 44,74 |
| 40% PETPA | 500 | 750° F. | 22,7 | 44,82 |
| PROCESS FLUID - CRUDE OIL - GULF COAST REFINERY | | | | |
| Blank (Control) | | 800° F. | 45,80,65,57 | — |
| 40% PETPA | | 800° F. | 15,30 | 76,51 |
| 40% ZZ | | 800° F. | 68,60,82 | −10,3,−22 |

| Additive, 500 ppm | % protection |
|---|---|
| PROCESS FLUID - CRUDE OIL - AUSTRALIAN REFINERY | |
| 40% ZZ | −2 |
| 70% PETPA | 57 |
| 40% Polyisobutenylthiophosphonic acid (MW isobutenyl moiety ≈ 1300) | 39 |
| 80% BETPA (Example 2) | 61 |
| 80% HGETPA (Example 2) | 39 |
| Blank (Control) | — |

Another set of tests was run on a test system similar to that described hereinabove in relation to Table I except that the process fluid is run once-through the heat exchanger instead of recirculating. However, in this particular test, the outlet temperature of the process fluid is maintained at a desired temperature. As fouling occurs, less heat is transferred to the process fluid, which is sensed by a temperature controller. More power is then supplied to the rod which increases the rod temperature so as to maintain the constant temperature of the process fluid outlet from the heat exchanger. The degree of fouling is therefore commensurate with the increase in rod temperature ΔT compared to a control. Results are reported in Table II.

TABLE II

| Additive, | Dose (ppm) | Rod Temp °F. | −ΔT | % Protection |
|---|---|---|---|---|
| PROCESS FLUID - CRUDE OIL - MIDWEST REFINERY | | | | |
| Blank (Control) | | 680 | 176,144,134,129 | — |
| 40% ZZ | (2,000) | 680 | 6,23 | 96,84 |
| 40% PETPA | (2,000) | 680 | 8 | 95 |
| Blank (Control) | | 710 | 117,98,73,44,42 | — |
| 40% ZZ | (2,000) | 710 | 78,45 | −4,40 |
| 40% PETPA | (2,000) | 710 | 0,15 | 100,80 |
| PROCESS FLUID - CRUDE OIL - GULF COAST REFINERY | | | | |
| Blank (Control) | | 625 | 93,96,96 | — |
| 40% ZZ | (1,000) | 625 | 59 | 38 |
| 40% PETPA | (1,000) | 625 | 32 | 66 |
| 40% PETPA | (2,000) | 625 | 33 | 65 |

Another series of tests was run on the test system described hereinabove in relation to Table II. This time, the rod temperature was controlled. The antifoulant efficacy of the various treatments was determined by the equation used in connection with Table I. Results are reported in Table III.

TABLE III

| Additive, | Dose (ppm) | Rod Temp °F. | −ΔT | % Protection |
|---|---|---|---|---|
| PROCESS FLUID - 38 CRUDE OIL - GULF COAST REFINERY | | | | |
| Blank (Control) | | 800 | 101,85 | — |
| 40% PETPA | (2,000) | 800 | 32 | 66 |
| 40% ZZ | (2,000) | 800 | 42 | 55 |
| Blank (Control) | | 750 | 94,97,97 | — |
| 40% PETPA | (2,000) | 750 | 56 | 42 |
| 40% ZZ | (2,000) | 750 | 79 | 18 |
| 40% ZZ | (1,000) | 750 | 68,59 | 29,39 |
| PROCESS FLUID - CRUDE OIL - MIDWEST REFINERY | | | | |
| Blank (Control) | | 870 | 56,55 | — |
| 40% ZZ | (2,000) | 870 | 29 | 48 |
| 40% PETPA | (2,000) | 870 | 27 | 51 |
| Blank (Control) | | 900 | 128,136 | — |
| 40% ZZ | (2,000) | 900 | 93 | 30 |
| 40% PETPA | (2,000) | 900 | 78 | 41 |
| PROCESS FLUID - CRUDE OIL - MIDWEST REFINERY | | | | |
| Blank (Control) | | 875 | 81,94 | |
| 40% ZZ | (2,000) | 875 | 63 | 28 |
| 40% PETPA | (2,000) | 875 | 52 | 41 |

ZZ in the above tests is a well known antifoulant thought to have the structure:

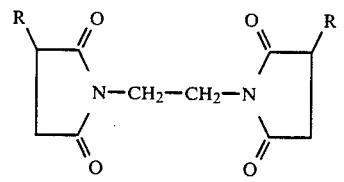

R is polyisobutylene.

As the examples clearly demonstrate, use of the antifoulants of the present invention provides significant improvement over the well known ZZ antifoulant.

The antifoulants of the invention may be used in any system wherein a petrochemical or hydrocarbon is processed at elevated temperatures, and wherein it is desired to minimize the accumulation of unwanted matter on heat transfer surfaces. For instance, the antifoulants may be used in fluid catalytic cracker unit slurry systems wherein it is common to employ significant amounts of inorganic catalyst in the hydrocarbon containing process stream.

In accordance with the patent statutes, the best mode of practicing the invention has been set forth. However, it will be apparent to those skilled in the art that many other modifications can be made without departing from the invention herein disclosed and described, the scope of the invention being limited only by the scope of the attached claims.

I claim:

1. A method of inhibiting fouling deposit formation in a petroleum hydrocarbon during processing thereof at temperatures between about 600° F. and about 1000° F. wherein, in the absence of antifouling treatment, fouling deposits are normally formed as a separate phase within said petroleum hydrocarbon impeding process throughput and thermal transfer and thus deleteriously affecting the yield of finished product, said method comprising adding to said petroleum hydrocarbon an antifouling amount of an antifouling compound selected from the group consisting of $C_1$–$C_5$ alkyl alcohol esters and polyglycol esters of polyisobutenylthiophosphonic acid.

2. A method as recited in claim 1 wherein between about 0.5–10,000 parts by weight of said antifoulant compound are dispersed in each one million parts by weight of said petroleum hydrocarbon.

3. A method as recited in claim 2 wherein said antifoulant compound is dispersed in said petroleum hydrocarbon in an amount of from about 1 to 500 parts of said antifoulant per one million parts of said petroleum hydrocarbon.

4. A method as recited in claim 1 wherein said antifoulant is a hexylene glycol ester of said polyisobutenylthiophosphonic acid.

5. A method as recited in claim 1 wherein said antifoulant is a pentaerythritol ester of said polyisobutenylthiophosphonic acid.

6. A method as recited in claim 1 wherein said antifoulant is a n-butanol ester of said polyisobutenyl thiophosphonic acid.

7. A method as recited in claim 1 wherein the molecular weight of said isobutenyl moiety of said polyisobutenylthiophosphonic acid is within the range of between about 600 and 5,000.

8. A method as recited in claim 7 wherein the molecular weight of said isobutenyl moiety is about 1300.

* * * * *

UNITED STATES PATENT AND TRADEMARK OFFICE

CERTIFICATE OF CORRECTION

PATENT NO. : 4,578,178

DATED : March 25, 1986

INVENTOR(S) : David R. Forester

It is certified that error appears in the above-identified patent and that said Letters Patent is hereby corrected as shown below:

Col. 3, line 42, change "EAMPLE" to --- EXAMPLE ---.

Col. 3, line 57, change "deleted" to --- detected ---.

Col. 3, line 61, change "polyisobutenthiophosphonic" to --- polyisobutenyl-thiophosphonic ---.

Col. 4, line 59 should appear directly above line 62.

Col. 5, line 20, change "-$\Delta$T" to ---$\Delta$T ---.

Col. 5, line 45, delete "38".

Signed and Sealed this

*Twenty-ninth* Day of *July 1986*

[SEAL]

*Attest:*

DONALD J. QUIGG

*Attesting Officer*

*Commissioner of Patents and Trademarks*